United States Patent [19]

Riaboy

[11] 4,240,420

[45] Dec. 23, 1980

[54] NOSE AND MOUTH FILTER COMBINATION

[76] Inventor: Florence Riaboy, 4819 Sorrento Ct., Cape Coral, Fla. 33904

[21] Appl. No.: 30,520

[22] Filed: Apr. 16, 1979

[51] Int. Cl.[3] ..... A62B 7/00

[52] U.S. Cl. ..... 128/206.14; 128/206.19; 55/511; 55/514; 55/DIG. 35

[58] Field of Search ..... 55/316, 387, 490, 501, 55/511, 524, DIG. 35, 514; 128/146.2, 206.14, 206.25, 207.13, 206.19

[56] References Cited

U.S. PATENT DOCUMENTS

| | | | |
|---|---|---|---|
| 893,213 | 7/1908 | Whiteway | 128/146.2 |
| 1,946,334 | 2/1934 | Schwartz | 128/146.2 |
| 2,928,388 | 3/1960 | Jaraslov | 128/206.14 |
| 3,019,127 | 1/1962 | Czerwonka et al. | 55/524 |
| 3,049,121 | 8/1962 | Brumfield et al. | 128/146.2 |
| 3,458,130 | 7/1969 | Juhlin | 55/511 |
| 4,004,584 | 1/1977 | Geaney | 128/146.2 |

*Primary Examiner*—Bernard Nozick

*Attorney, Agent, or Firm*—Alfred E. Wilson

[57] ABSTRACT

Individual disposable nose and mouth filters, in combination, each of which is comprised of a sheet of a suitable air filtering material, sized and configurated respectively to loosely cover the mouth and nostril portions of the face of a wearer, continuous strips of a suitable pressure sensitive adhesive tape are engaged in a peripheral relation to outer peripheral edge areas of the respective filters and outer periphers of the adhesive tape, normally covered by removable backing strips, are extended beyond the filters for secure engagement with face areas surrounding the mouth and nostril areas of the wearer's face.

1 Claim, 3 Drawing Figures

NOSE AND MOUTH FILTER COMBINATION

BACKGROUND OF THE PRESENT INVENTION

The present invention pertains to individual mouth and nose filter units utilizing continuous strips of peripheral pressure sensitive adhesive tape for attachment of the filter in a covering relation to the mouth and nostril areas of a person's face. The filter material may be formed of an appropriate tissue such as Kleenex, or similar material in one or more plies to filter solids from the air, or the filter material may be impregnated with activated charcoal or other suitable materials to filter out gaseous elements in addition to the solids. Previously designed mask filters that cover both the nose and mouth tend to collect a pocket of warm and humid air inside the mask during exhilation. This warm humid air is then inhaled making the masks uncomfortable to wear. The two separate nose and mouth filters of my invention eliminates this problem. No pocket of warm humid air collects inside the filters and air inhaled must of necessity pass through the filter material.

The filters of the present invention may be used for example by textile works, farmers, asbestos workers, lumber mill workers or carpenters, spray paint workers or by the general public on the streets of air polluted cities in which even they may be produced in decorator colors or include other embellishments.

Therefore, one of the principal objects of the present invention is to provide very inexpensive individual nose and mouth filters, which are comfortable to wear, each of which is constructed of any appropriate commercially available filter material, in one or more plies sealed about an outer peripheral edge area to an inner peripheral portion of an appropriate single sided pressure sensitive adhesive tape, the outer peripheral portion of which is normally covered by a cover strip to be removed to permit the securement of the filter, in a sealed engagement, about the nostril and mouth areas of a person.

A further object of the present invention is to provide individual nose and mouth filters which are disposable and which may be flattened for packaging relatively small sterile envelopes or the like such as commercially available bandages or the like.

Another object of the present invention is to provide nose and mouth filters which may be worn individually or in combination.

DESCRIPTION OF A PREFERRED EMBODIMENT

Figure 1:
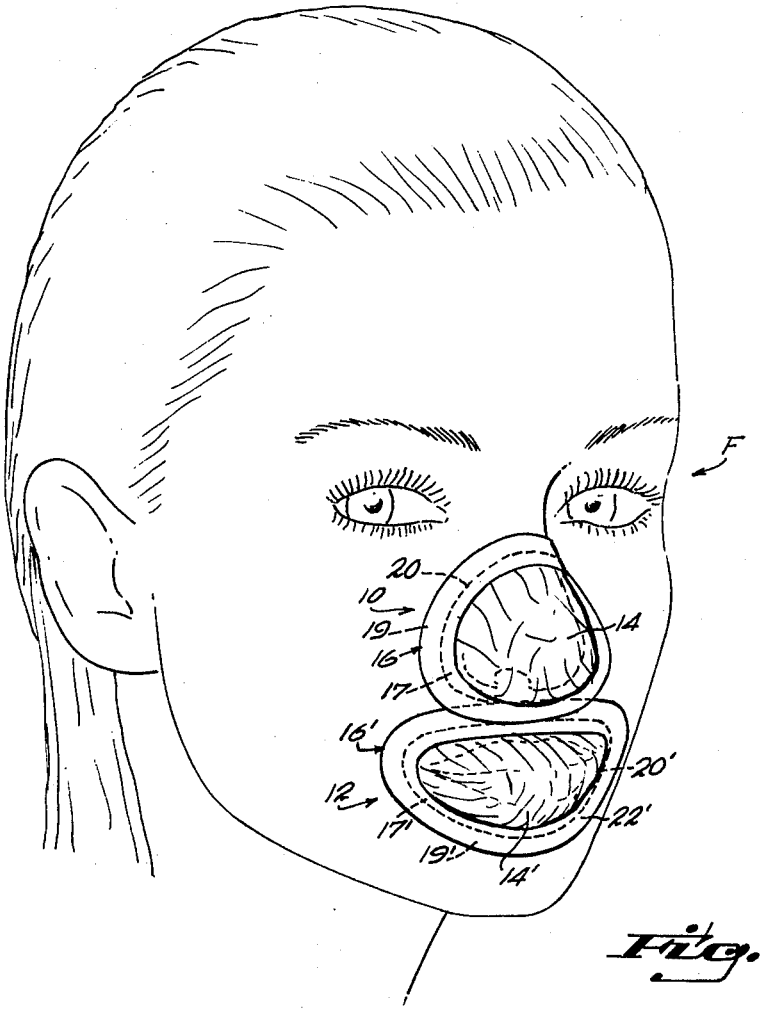
FIG. 1 is a front perspective view of a person's face illustrating the nose and mouth filters of the present invention adhesively secured in place.

With reference to the drawings in which like reference characters designate like or corresponding parts throughout the several views and with particular reference to FIG. 1, the nose and mouth filters, indicated generally at 10 and 12, are illustrated in a secured relation to the nostril and mouth areas of a person's face F.

Figure 3:
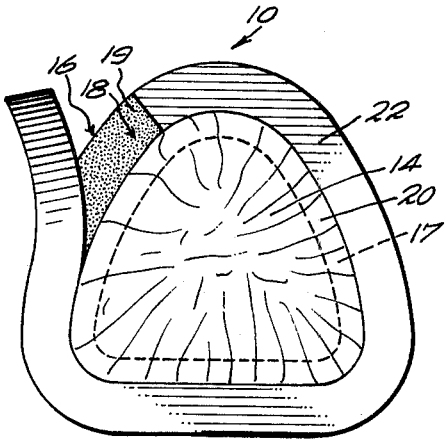
FIG. 3 is a view of the nose filter, similar to the mouth filter of FIG. 2.

With particular reference to FIGS. 1 and 3, the nose filter 10 is comprised of a central filter member 14 and a continuous peripheral strip of one-sided pressure sensitive adhesive tape 16, sized and configuarated to determine the end portion of the nose, including the nostrils, to be covered by the filter member 14. An inner peripheral portion 17 of the adhesive material 18 of tape 16 overlies and is adhesively secured about the outer peripheral portion 20 of the filter member 14. The outer peripheral portion 19 of the adhesive material 18 of tape 16 is normally covered by a backing tape 22 which is removed, in the manner indicated in FIG. 3, to secure the nose filter 10 in a sealed position about the nostril area of the nose as in FIG. 1.

The filter member 14 may be formed of a material such as that used in commercially available tissues such as "Kleenex" or any other commercially available filtering material which will filter unwanted solids from the air, or, alternatively, the filter may be impregnated with acitivated charcoal or other similar materials to remove gaseous impurities from the air as well as th solids. One or more plies of filtering material may be used. It should also be noted that the filter material of member 14 is provided with a sufficient degree of fullness to loosely envelop the nostril end portion of the nose as in FIG. 1.

Figure 2:
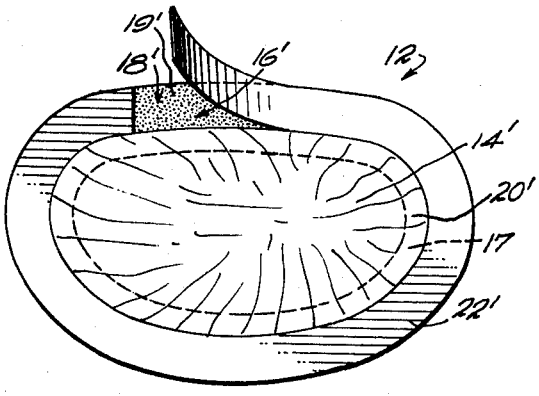
FIG. 2 is a plan view of the inner side of the mouth filter illustrating the backing strip being removed from the peripheral pressure sensitive adhesive tpae.

The mouth filter assembly 12 of FIGS. 1 and 2 is formed in the same manner of the same materials as above described relative to the nose filter 10 and will therefore not be described in detail. The only difference resides in the filter assembly 12 being configurated to cover the mouth area of the face in a secure sealed relation instead of the nostril area and, therefore, like reference characters with primes are applied thereto.

I claim:

1. Individual nose and mouth filters, in combination, comprising a pair of central filter elements, formed of a suitable flexible filter material, a first of which is sized to loosely cover a predetermined lower area of the nose including the nostrils, and a second of which is sized to loosely cover the mouth area, each of said first and second filters including an outwardly extending peripheral portion and being provided with a continuous strip of one-sided pressure sensitive adhesive tape including an inner peripheral adhesive portion secured to said filter materials outwardly extending peripheral portion and an outwardly extending peripheral adhesive portion for secure engagement with a predetermined facial skin area of a user, the pressure sensitive tape portion of one of the filters overlying and bonded to the pressure sensitive tape portion of the other filter.

* * * * *